US006318307B1

(12) United States Patent
Heer

(10) Patent No.: US 6,318,307 B1
(45) Date of Patent: Nov. 20, 2001

(54) COOLING SYSTEM FOR AN INTERNAL COMBUSTION ENGINE

(75) Inventor: Siegfried Heer, Kirchdorf/Krems (AT)

(73) Assignee: TCG Unitech Aktiengesellschaft, Kirchdorf/Krems (AT)

( * ) Notice: Subject to any disclaimer, the term of this patent is extended or adjusted under 35 U.S.C. 154(b) by 0 days.

(21) Appl. No.: 09/552,580

(22) Filed: Apr. 19, 2000

(30) Foreign Application Priority Data

Apr. 22, 1999 (AT) ..... 714/99

(51) Int. Cl.[7] ..... F01P 5/10
(52) U.S. Cl. ..... 123/41.44
(58) Field of Search ..... 123/41.44, 41.15, 123/41.46

(56) References Cited

FOREIGN PATENT DOCUMENTS 2631121 1/1978 (DE) .
4116496 12/1991 (DE) .
4038695 6/1992 (DE) .
57193716 11/1982 (JP) .

*Primary Examiner*—Tony M. Argenbright
*Assistant Examiner*—Katrina B. Harris
(74) *Attorney, Agent, or Firm*—Dykema Gossett PLLC

(57) ABSTRACT

The present invention relates to a cooling system for an internal combustion engine with an electrically driven coolant pump designed to circulate a coolant through the internal combustion engine and through a radiator designed to dissipate the heat, wherein a safety device is provided which has a device for recognizing cases of emergency and an emergency operating device, wherein the device for recognizing cases of emergency is devised to detect a perturbation in the area of the electrically driven coolant pump. Increased reliability is achieved by devising the emergency operating device in such a manner that, in case of a perturbation in the area of the coolant pump, it causes a mechanical connection of the coolant pump with a component part driven by the internal combustion engine to be established.

11 Claims, 2 Drawing Sheets

COOLING SYSTEM FOR AN INTERNAL COMBUSTION ENGINE

BACKGROUND OF THE INVENTION

The present invention relates to a cooling system for an internal combustion engine with an electrically driven coolant pump designed to circulate a coolant through the internal combustion engine and through a radiator designed to dissipate the heat, wherein a safety device is provided which has a device for recognizing cases of emergency and an emergency operating device, wherein the device for recognizing cases of emergency is devised to detect a perturbation in the area of the electrically driven coolant pump.

Usually, the coolant pump for internal combustion engines is directly driven by the internal combustion engine via a driving belt. This entails that the speed of the coolant pump is proportional to the speed of the internal combustion engine. With the commonly utilized radial pumps, the flow rate and with it the required driving power increases superproportionally with the speed. When designing the coolant pump, the range of low speed is critical. As a result, in a conventional coolant pump that is properly designed for the range of low speed, the flow rate in the range of high speed is considerably greater than it would be necessary. That is why the power needed to drive the coolant pump at high speed has to be graded, for the most part, as genuine power loss.

An electrically driven coolant pump whose speed is inherently independent of the speed of the internal combustion engine has the advantage to be capable of adjusting, for each operational state of the internal combustion engine, the minimum flow rate needed in each case. This makes it possible to considerably reduce the energy demand of the coolant pump which becomes particularly noticeable in the range of high speed, low load and when the engine is cold. Wide spread use of electrically driven coolant pumps for internal combustion engines was hereto before hindered by the fact that a coolant pump is an extremely critical component part. In case the coolant pump breaks down, operation of the internal combustion engine has to be stopped immediately in order to prevent destruction due to overheating.

DESCRIPTION OF THE PRIOR ART

DE 41 16 496 A discloses a safety device for an internal combustion engine cooled by a circulating coolant. This safety device detects breakdown of an electric coolant pump and, depending on this detection, ignition timing or adjustment of the quantity of injected fuel is brought about. Overheating of the internal combustion engine can thus be prevented. JP 57-193 716 suggests a similar solution. Such solutions only permit very limited operation of internal combustion engines subjected to low thermal load. Such solutions however cannot reliably prevent overheating of the internal combustion engine when the coolant pump breaks down before thermal load occurs.

DE 40 38 695 A discloses a drive assembly for an auxiliary unit of an internal combustion engine. Here, the starter or the rotor of an electric motor is fixed on a pivoted part driven by the internal combustion engine and the auxiliary unit is driven by the other part of the electric motor. This makes it possible to drive a fan or the like with relatively little expenditure of energy and to still regulate its power. It does not mention the difficulties associated with the breakdown of an electric coolant pump. DE 26 31 121 A relates to a liquid cooled internal combustion engine provided with a directly driven coolant pump on one side and with an additional circulating pump on the other so that the flow of the cooling agent can be matched to the requirements of the moment. Here too, no mention is made of the problem arising when an internal combustion engine, which is normally only supplied by an electrically driven coolant pump, breaks down.

SUMMARY OF THE INVENTION

It is an object of the present invention to provide a cooling system that permits to exploit the advantages of an electrically driven coolant pump on one side and to allow for the need of the most comprehensive possible dependability of the internal combustion engine.

To achieve these objects, the emergency operating device is designed to bring about, in case of a breakdown in the area of the coolant pump, a mechanical connection of the coolant pump with a component part driven by the internal combustion engine.

The essential point of the invention is that the operation of the electrically driven coolant pump is being monitored. When a failure has been noticed, a mechanical connection of the coolant pump with the internal combustion engine is established in order to ensure emergency service. Depending on the space available, it may be done by the driving belt that drives the generator, the compressor of the air-conditioning unit or the like. It is particularly advantageous when the emergency operating device establishes a connection of the coolant pump with a driving belt that is driven by the internal combustion engine. A particularly simple design is obtained when the electrically driven coolant pump is provided with an engine of the type of an external rotor motor in which a rotor encompasses a stator on its outer periphery. In this case, the outer peripherical surface of the rotor may be used as a plane of action for the component part driven by the internal combustion engine.

In a particularly preferred embodiment of the invention, the emergency operating device is provided with a frictional wheel that can be moved into mesh with a rotating part of the coolant pump and with a component part driven by the internal combustion engine by spring force. Such a frictional wheel permits transmission of a driving power that is sufficient for emergency operation of the coolant pump. Since minimal demands are made upon useful life of the frictional wheel, selection of the corresponding materials can be very free.

In an alternative embodiment of the invention, the electrically driven coolant pump is movably supported and can be moved into mesh with a component part that is driven by the internal combustion engine by the emergency operating device. Thus, a rotatable component part of the coolant pump can be moved directly into mesh with a driving belt or the like, thus simplifying the layout.

In another alternative embodiment of the invention, the emergency operating device can have a magnetic coupling by means of which the coolant pump can be directly driven by the internal combustion engine. Thereby the coolant pump is arranged coaxially with another unit or component part that is driven by the internal combustion engine, like for example the generator, the oil-pump or the pulley for driving a camshaft.

It is particularly advantageous when the device for recognizing emergency cases is provided with a temperature probe that detects the temperature of the internal combustion engine and/or of the cooling agent. It is thereby presumed that an unacceptable increase of the coolant's temperature or of the temperature of the internal combustion engine is occasioned by a failure in the area of the coolant pump. As an alternative or in addition thereto the device for recognizing emergency cases can be provided with a sensor devised to detect the speed of the coolant pump. Thus, emergency operation may be prevented from being triggered in cases of extreme operation of the internal combustion engine when the coolant pump itself is still operative.

In order to increase operational reliability of a motor vehicle equipped with a cooling system according to the invention, the emergency operating device can also be designed in such a manner that a mechanical connection of the coolant pump with a component part driven by the internal combustion engine, once established, can only be undone at the shop and that a monitor indicates the condition of the emergency operating device. Thus, the emergency system is prevented from being run for a longer period of time and from finally becoming overloaded.

The present invention also relates to an internal combustion engine equipped with the cooling system described above.

The present invention will be described more explicitly in the following with the help of the embodiments illustrated in the figures.

DETAILED DESCRIPTION OF THE PREFERRED EMBODIMENTS

Figure 1:
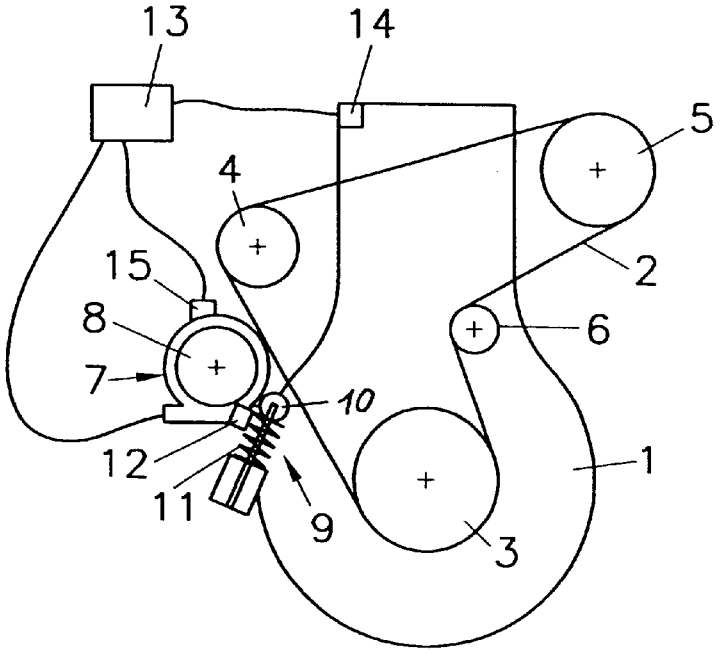
FIG. 1 is a top view of a first embodiment of an internal combustion engine with a cooling system according to the invention represented schematically.

FIG. 1 shows an internal combustion engine 1 on the front side of which a driving belt 2 is arranged. The driving belt 2 wraps pulleys 3, 4 and 5, wherein the first pulley 3 is coupled to the crankshaft (not shown) of the internal combustion engine 1, whereas the other pulleys 4 and 5 are coupled to auxiliary units that are not illustrated either in the drawings herein and that are driven by the internal combustion engine 1. These auxiliary units may for example be the generator, a compressor for an air-conditioning unit or the like. A belt stretcher 6 is responsible for the appropriate tension of the driving belt 2. An electrically driven coolant pump 7 is also arranged in the area of the internal combustion engine 1, said coolant pump being designed as a radial centrifugal pump having an electric motor directly flanged to it. On the level of the driving belt 2, a driving pulley 8 directly coupled to the pump but spaced from the driving belt 2 is provided.

A connection means of an emergency operating device 9 has got the shape of a frictional wheel 10 that is pressed into the space between the driving pulley 8 and the driving belt 2 by a spring 11. During normal operation however, a retaining clip 12 keeps the frictional wheel 10 in a withdrawn position in which it touches neither the driving belt 2 nor the driving pulley 8.

A device for recognizing emergency cases 13 is connected to a temperature probe 14 that detects the temperature of the internal combustion engine 1. The device for recognizing emergency cases 13 is furthermore connected with a speed sensor 15 that determines the speed of the coolant pump 7. When an unacceptable high temperature of the internal combustion engine 1 or the standstill of the coolant pump 7 is recognized, the device for recognizing emergency cases 13 triggers the clip 12 so that the frictional wheel 10 establishes a non positive connection between the driving belt 2 and the driving pulley 8. Thus, the coolant pump 7 can also be driven mechanically by the driving belt 2.

Figure 2:
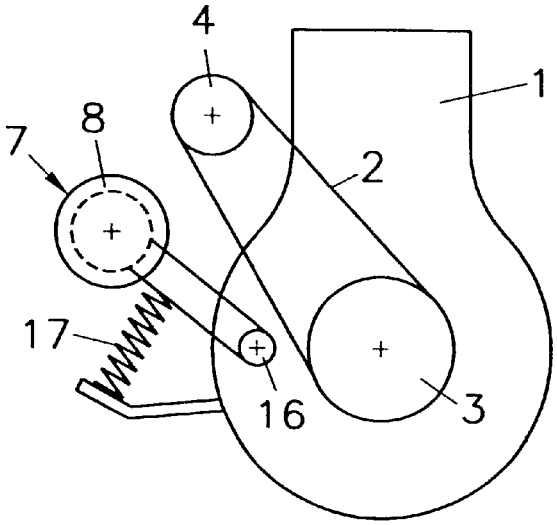
FIG. 2 is a representation according to FIG. 1 of another embodiment of the invention.

The embodiment shown in FIG. 2 mainly differs from the embodiment of FIG. 1 by the fact that the coolant pump 7 as a whole is arranged so as to be rotatable about an axis 16. A spring 17 presses the overall coolant pump 7 against the driving belt 2, a holding device that is not illustrated in the drawings herein being provided which keeps the coolant pump 7 away from the driving belt 2 during normal operation. Mechanical mesh is only established in case of an emergency.

Figure 3:
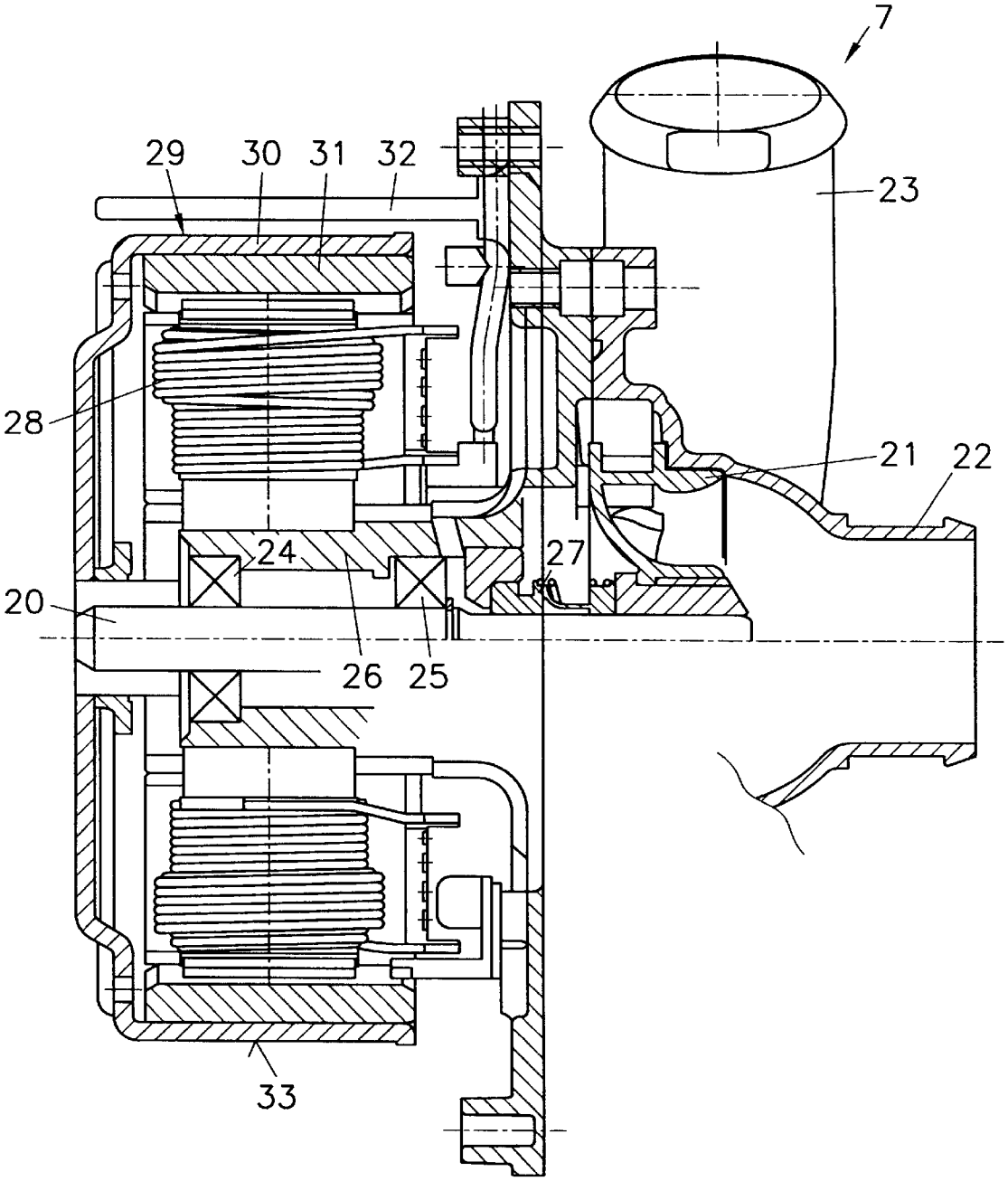
FIG. 3 is an electrically driven coolant pump with an external rotor motor.

FIG. 3 shows a longitudinal section of a particularly suitable coolant pump 7 of the invention being of the type of an external rotor motor. The coolant pump 7 consists of a drive shaft 20 on which an impeller 21 is fastened. The cooling agent is sucked via an aspiration port 22 and is thrown into a pressure pipe 23 by the rotation of the impeller 21. The drive shaft 20 is supported by rolling bearings on a stationary bush 26, a rotating mechanical seal 27 serving to seal it against the cooling agent. A stator 28 composed of electromagnetic windings is fixed on the bush 26. The rotor of the thus constituted electric motor is referred to with numeral 29 and consists of a substantially pot-shaped component part 30 on the inner peripherical surface of which permanent magnets 31 are fastened. The rotor 29 is rigidly connected to the drive shaft 20. In order to protect the rotating external surface of the component part 30 from the outside, rods have been installed on critical places. The free external surfaces 33 of the component part 30 constitute the plane of action for the frictional wheel 10 in the embodiment of FIG. 1 and for the driving belt 2 in the embodiment of FIG. 2.

The present invention permits to combine the advantages of an electrically driven coolant pump, which consist in reduced energy consumption, with the reliability of a conventionally driven coolant pump.

I claim:

1. A cooling system for an internal combustion engine with a) an electrically driven coolant pump designed to circulate a coolant through the internal combustion engine and through a radiator designed to dissipate the heat, b) a safety device comprising a device for recognizing cases of emergency with respect to the electrically driven cooling pump and an emergency operating device, and c) a connection means for mechanically connecting the coolant pump with a component part driven by the internal combustion engine in case of an emergency with respect to the electrically driven coolant pump.

2. A cooling system according to claim 1, wherein the connections means establishes a connection of the coolant pump with a driving belt that is driven by the internal combustion engine.

3. A cooling system according to claim 1, wherein the electrically driven coolant pump is provided with an engine of the type of an external rotor motor in which a rotor encompasses a stator on its outer periphery.

4. A cooling system according to claim 1, wherein the connection means is designed as a frictional wheel that can be engaged with a rotating part of the coolant pump by means of spring force and by the component part driven by the internal combustion engine.

5. An internal combustion engine comprising a cooling system according to claim 4.

6. A cooling system according to claim 1, wherein the electrically driven coolant pump is movably supported and can be engaged with a component part that is driven by the internal combustion engine by the emergency operating device.

7. A cooling system according to claim 1, wherein the emergency operating device has a magnetic coupling by means of which the coolant pump is directly driven by the internal combustion engine.

8. A cooling system according to claim 1, wherein the device for recognizing emergency cases is provided with a temperature sensor that detects the temperature of the internal combustion engine and of the cooling agent.

9. A cooling system according to claim 1, wherein the device for recognizing emergency cases is provided with a sensor devised to detect the speed of the coolant pump.

10. A cooling system according to claim 1, wherein the emergency operating device is designed in such a manner that a mechanical connection of the coolant pump with a component part driven by the internal combustion engine, once established, can only be undone at the shop and wherein a monitor indicates the condition of the emergency operating device.

11. An internal combustion engine comprising a cooling system according to claim 1.

* * * * *